United States Patent [19]

Reimer

[11] Patent Number: 4,541,252

[45] Date of Patent: Sep. 17, 1985

[54] MECHANIZED SELF EVACUATING FRAGMENTARY ICE STORAGE BIN

[75] Inventor: Peter Reimer, Middlebury, Ind.

[73] Assignee: Index Supply Company, Inc., La Porte, Ind.

[21] Appl. No.: 505,262

[22] Filed: Jun. 17, 1983

[51] Int. Cl.[4] ..... F25C 5/18

[52] U.S. Cl. ..... 62/344; 414/325

[58] Field of Search ..... 62/344; 414/325–327; 198/841

[56] References Cited

U.S. PATENT DOCUMENTS

| | | | |
|---|---|---|---|
| 897,942 | 9/1908 | Wangelin . | |
| 2,222,024 | 11/1940 | Field | 62/344 X |
| 2,646,899 | 7/1953 | Stover . | |
| 2,791,887 | 5/1957 | Hennig | 62/344 X |
| 2,927,440 | 3/1960 | Kohl | 62/344 X |
| 3,127,756 | 4/1964 | Field . | |
| 3,797,267 | 3/1974 | Hagen | 62/344 X |
| 3,842,993 | 10/1974 | Hagen . | |
| 3,908,837 | 9/1975 | Strocker . | |
| 3,918,266 | 11/1975 | Gindy et al. | 62/344 X |
| 3,955,666 | 5/1976 | Braun et al. | 198/731 X |
| 4,042,129 | 8/1977 | Hampton . | |
| 4,126,236 | 11/1978 | Schultz . | |
| 4,165,202 | 8/1979 | Hashjen . | |
| 4,168,937 | 9/1979 | Hagen . | |
| 4,176,528 | 12/1979 | Frohbieter | 62/344 |

FOREIGN PATENT DOCUMENTS

| | | | |
|---|---|---|---|
| 997161 | 10/1949 | France | 62/344 |

*Primary Examiner*—William E. Tapolcai

*Attorney, Agent, or Firm*—Fleit, Jacobson, Cohn & Price

[57] ABSTRACT

An ice storage bin for the storage and delivery of fragmentary ice for use in an enclosed area. The ice storage bin has at least one ice rake assembly having an arm which pivots about a lower corner of the bin and supports rakes that serve to move the fragmentary ice contained in the bin toward a screw for discharge from the bin. A rake drive shaft provides the pivot axis about which the rake arm rotates. The rake arm contacts the ice in storage by the action of gravity so that the rakes dig into the ice. An additional rake arm assembly can be disposed on the opposite side of the bin or parallel to the first rake arm assembly to increase the capacity of the bin. The bin is formed from beams which can be premanufactured and readily placed in a standard storage container. Apparatus are provided for raising the ice rake arm from the surface of the ice to a vertical position during the filling of the ice bin.

7 Claims, 8 Drawing Figures

MECHANIZED SELF EVACUATING FRAGMENTARY ICE STORAGE BIN

BACKGROUND OF THE INVENTION

1. Field of the Invention

The present invention relates to storage bins with material handling conveyors. In particular, it relates to an ice storage bin or receptacle which has a driven conveyor to aid in the discharge of material from the bin.

2. Description of the Prior Art

The automatic and sanitary handling of fragmentary ice in an ice storage bin has historically presented an exceedingly difficult problem. Fragmentary ice stored in a storage bin tends to fuse together and become difficult to move. As a result, fragmentary ice in bulk storage is difficult to handle because it is virtually incapable of flowing out of the bin by gravity. The inability of bulk fragmentary ice to flow by gravity has been recognized and the prior art has employed a device known as an ice rake to facilitate the handling of bulk ice. An ice rake is a type of drag conveyor which contacts the top of a pile of ice and is maintained in contact therewith by cables and weights.

In the past, ice rakes have been constructed so they are positioned horizontally on an ice pile within the bin and serve to remove the fragmentary ice from the top of the pile to a discharge conveyor. Such systems have the disadvantage that they require considerable overhead clearance for the pulleys, cables, and motors required to maintain the ice rake in a horizontal position and to control the movement of the ice rake. In addition, such devices typically require a cumbersome counterweight movement mechanism in order to raise the ice rake to refill the bin with a new supply of fragmentary ice.

A further disadvantage lies in the requirement that most ice handling mechanisms must be constructed particularly for the specific bin in which they are to work. Such custom-made devices are difficult to produce in an economical manner so the cost of manufacturing and installing such devices tends to be very high.

Various bin unloading systems have been proposed for materials other than fragmentary ice; however, many of them are inappropriate for use in the sanitary environment required for the storage and handling of ice. In particular, many of the conveying devices used for other materials have motors and gears located within the storage chamber, which could lead to the introduction of grease or other debris into the ice bin. Bin unloading systems such as these are therefore inappropriate for use in bulk ice storage bins.

Rakes often are raised and lowered by timing devices, and misjudgment of ice flow or ascent of rake arm can bury arms in ice. Thus, there is a need for an ice handling device which can be economically constructed for use in ice storage bins of various sizes in order to provide efficient, sanitary unloading of fragmentary ice. The present invention is directed toward filling that need.

SUMMARY OF THE INVENTION

The present invention relates to a low cost unitary ice bin and conveying structure. The structure disclosed herein is designed for storage facilities which require optimum use of a limited amount of space. A self evacuation ice storage bin according to the invention has a support frame to which an ice rake arm is pivotably attached. A drive is provided to move rakes along the rake arm to a discharge device which carries ice from the bin. Devices according to this invention are designed so that they may be prefabricated and assembled for use in the intended storage area. Manufacturing and assembly are therefore low in cost. Further, the device is simple to operate with minimum maintenance.

Thus, it is a primary object of the present invention to provide a simplified, low cost, unitary self-evacuating fragmentary ice storage bin.

It is a further object of the invention to provide a device which is operable in bins having widely varying dimensions, such as bins which have a low ceiling height and therefore minimal clearance for an ice handling device, bins having widths substantially greater than their lengths, and bins having lengths substantially greater than their widths.

It is yet another object of the present invention to provide an ice storage bin which optimally utilizes the space available for the storage of ice, and minimizes the amount of space required for the ice handling apparatus.

These and other objects and advantages will become more apparent when reference is made to the following detailed description of preferred embodiments and the drawings referred to therein.

BRIEF DESCRIPTION OF THE DRAWINGS

In the detailed description of the preferred embodiments of the invention hereinafter presented, reference is made to the accompanying drawings, in which.

DESCRIPTION OF THE PREFERRED EMBODIMENTS

The present description will be directed in particular to elements forming part of, or cooperating more directly with, the present invention. Elements not specifically shown or described herein are understood to be selectable from those known in the art. Also, the same reference numearls have been used to identify the same or similar components in the various illustrated embodiments of the invention.

Figure 1:
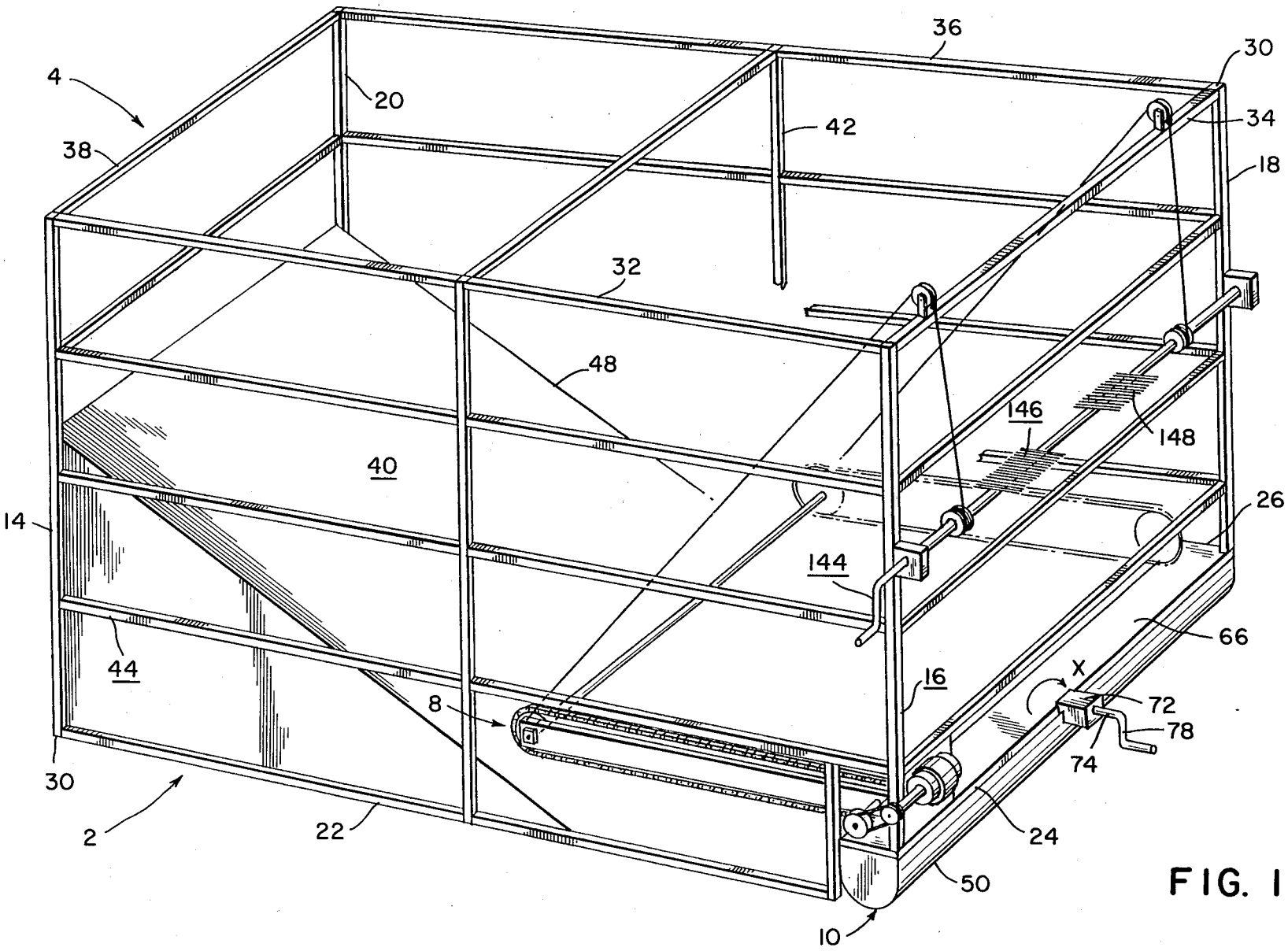
FIG. 1 is a schematic perspective of one embodiment of a self-evacuating fragmentary ice storage bin according to the present invention.
Figure 2:
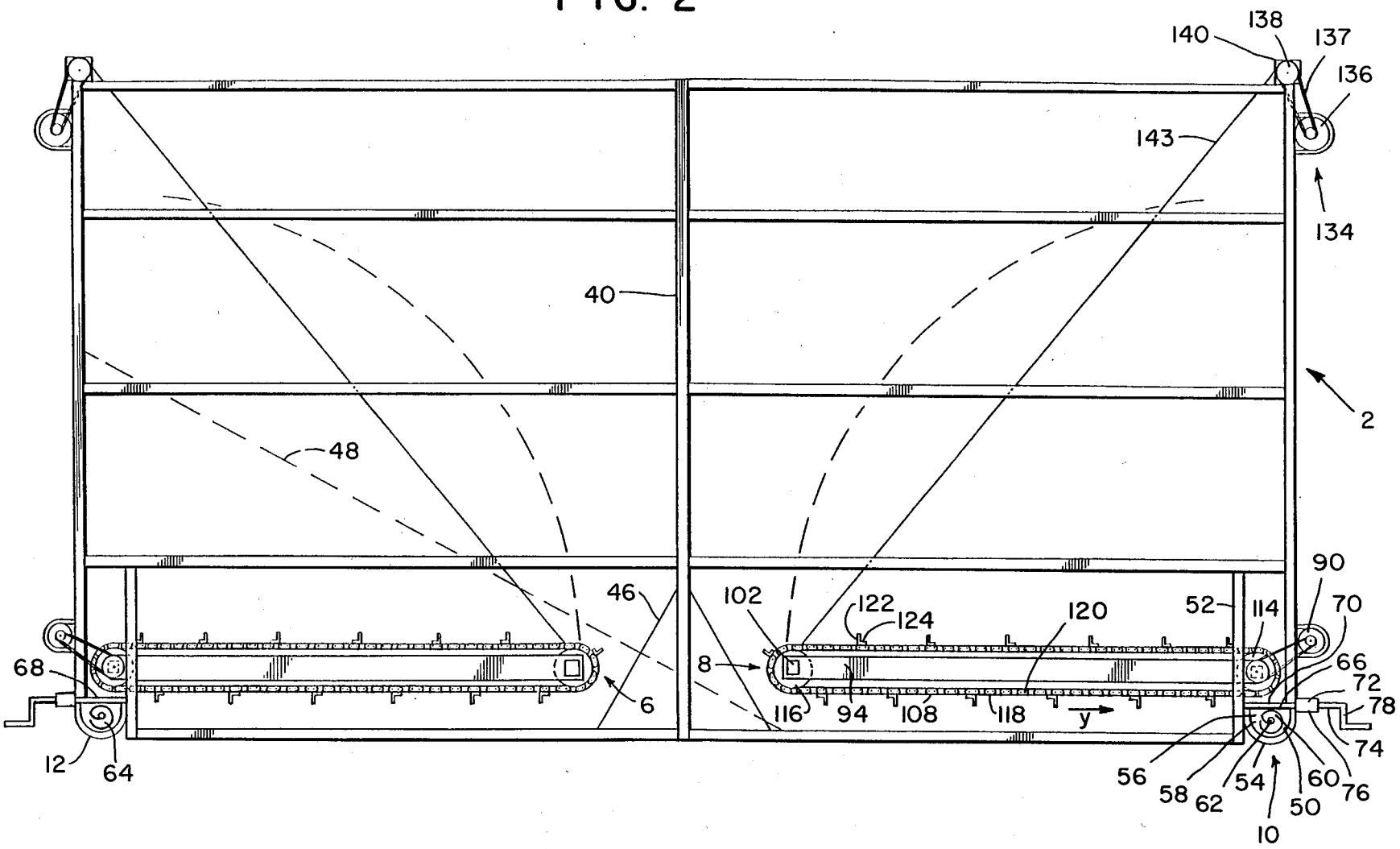
FIG. 2 is a schematic front view of another embodiment according to the present invention.

A self-evacuating fragmentary ice storage bin according to the present invention, shown in FIGS. 1 and 2 generally at 2, comprises an exterior support structure 4, ice rake assemblies 6 and 8, and discharge conveyors 10 and 12.

Exterior support structure 4 has sides of generally rectangular shape constructed from vertical and horizontal beams. The resulting structure is without a floor or ceiling and may be inserted into an existing insulated structure. Preferably, vertical metal plates are attached to interior surfaces of the beams to form a partially enclosed space within the insulated structure.

Exterior support structure 4 has vertically disposed corner support beams 14, 16, 18 and 20. Forming the bottom of the container are horizontally arranged connecting beams 22, 24, 26 and 28. The horizontal connecting beams are connected to the vertical corner support beams at the respective corners, for example 30, by appropriate means such as welding or bolting. The top of the exterior support structure 4 is formed by horizontal connecting beams 32, 34, 36, and 38 which are connected to the vertical corner support beams to form a generally rectangular top portion. For added stability, additional vertical supports 40 and 42 are attached to the upper and lower horizontal connection beams at points midway between corner support beams 14 and 16 and 18 and 20, respectively. These additional support beams are generally parallel to their respective corner beams and are attached to the top and bottom horizontal connecting beams in order to provide rigidity to the structure.

Additional horizontal support beams, such as shown at 44, are provided on each of the sides and ends of the container. The precise number of additional support beams depends on the dimensions of the bin. In the preferred embodiment, three are used on each side. It will be appreciated that other arrangements of beams can be used to provide the support structure 4.

With reference to the embodiment of FIG. 2, a generally triangular divider 46 is employed in the dual rake bin configuration and is located on the floor of the bin midway between the ends of the bin. The elongated, triangular divider extends across the center of the bin with one flat side placed on the floor and the opposite apex oriented across the bin between the additional vertical support beams 40 and 42. This divider acts to distribute the ice on either side of the apex so that the ice can be moved to one of the two discharge conveyors by its associated rake arm. Inclusion of such a divider eliminates the possibility of an amount of ice remaining undistributed in the center of the bin floor.

In an alternate embodiment having only one rake arm, a sloping bottom portion 48 (shown in phantom) is employed and used to cause the ice to move by gravity towards the single arm. Sloping bottom 48 is located in the end of the device opposite the single rake arm and extends across the width of the ice bin. It is inclined a sufficient angle, for example 30° to the horizontal, so that the ice will slide down the ramp to be picked up and conveyed by the rake arm.

Figure 5:
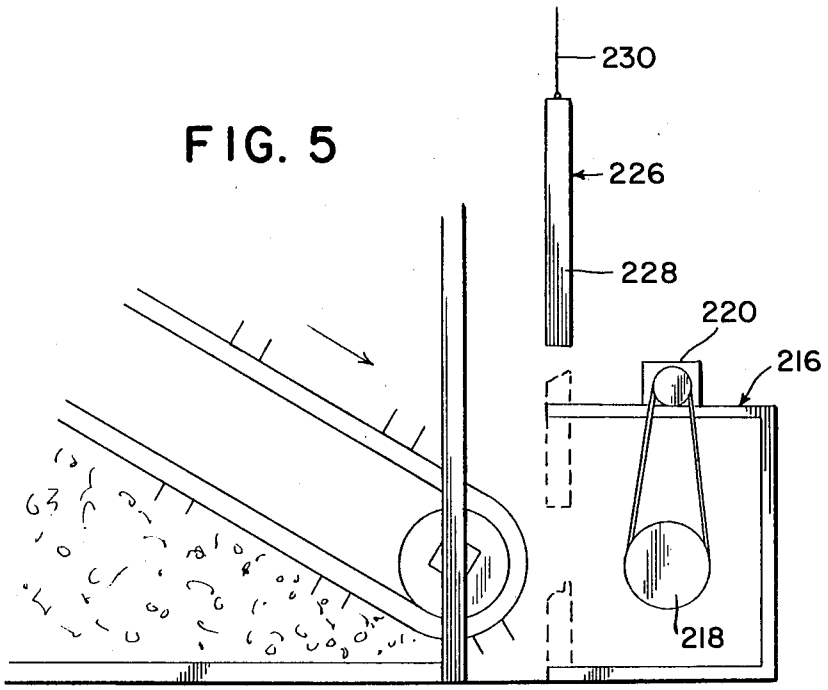
FIG. 5 is a schematic representation of another embodiment according to the present invention.
Figure 7:
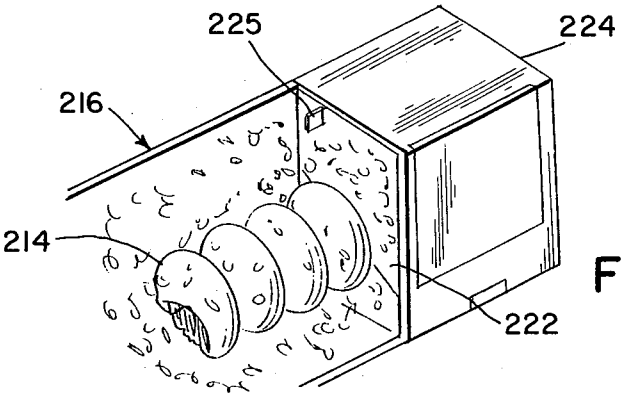
FIG. 7 is a perspective of a discharge portion of the embodiment of FIG. 5.

The bottom of external support structure 4 forms an elongated rectangle with short and long sides. Located along one of the short sides at the bottom of the bin is a screw conveyor 50 for the discharge of ice brought to it by the rake arm. With continued reference to FIG. 2, the screw conveyor 50 is attached to, and supported by, screw conveyor support beam 52. The screw conveyor 50 has a U-shaped trough 54 extending the length of the short side of the exterior support structure. The U-shaped trough is oriented so that the open end 56 opens upward to receive ice discharged from the rake arm. Disposed within the U-shaped trough is a screw auger 58 which serves to convey the ice through trough 54 to discharge at the open end located on the front of the bin. Screw auger 58 consists of an auger having an outwardly extending blade 60 disposed around the central shaft 62 in a helical configuration along the length of the screw. Screw auger 58 has one end driven by a drive motor (not shown) and is rotated so that the ice is moved in a direction of discharge through the action of the helical blade. The drive motor is external of the bin storage. In a preferred embodiment, as illustrated in FIGS. 5 and 7, this eliminates need for a separate trough, lowers the ice level in the bin to a few inches off the floor, and eliminates the need to recess a channel within the floor of the insulated structure.

In an alternate embodiment employing dual ice rakes, as shown in FIG. 2, a second screw conveyor 64 is provided for handling the discharge of ice from a second rake arm assembly. The structure of the second screw conveyor 64 is similar to that of screw conveyor 50 and therefore will not be described in detail.

In order to prevent ice from jamming or clogging the screw conveyors when the ice bin is being filled, conveyor door assemblies 66 and 68 are provided to cover screw conveyors 50 and 64, respectively. Since each of the screw conveyor doors are of like construction, only conveyor door assembly 66 will be described.

Conveyor assembly door 66 (shown in FIGS. 1 and 2) comprises a door 70 of generally rectangular shape which is designed to cover and seal the opening 56 of U-shaped trough 54. The positioning of conveyor door 70 is controlled by manual drive screw 72. The manual drive screw consists of a helically threaded shaft portion 74 which is received by an internally threaded bushing 76 which is attached near the midpoint of horizontal beam 24. Attached to the outward end of the helical threaded shaft 76 is turning handle 78 which, when rotated, causes the conveyor door 70 to open or close. The end of helically threaded shaft 74 opposite handle 78 is attached to the conveyor door 70 so that when the handle is rotated in a clockwise direction, indicated by the arrow labelled "X" in FIG. 1, the door will move over the U-shaped trough 54 and prevent ice from entering. When the turning handle 78, and screw 74 are rotated in a counter-clockwise direction, the conveyor door 70 moves toward the outside of the ice bin and opens U-shaped trough 54 allowing it to receive ice.

Conveyor door 70 can also be used to control the amount and the rate of ice being discharged through screw conveyor 50 by being adjusted to be only partly open.

Figure 3:
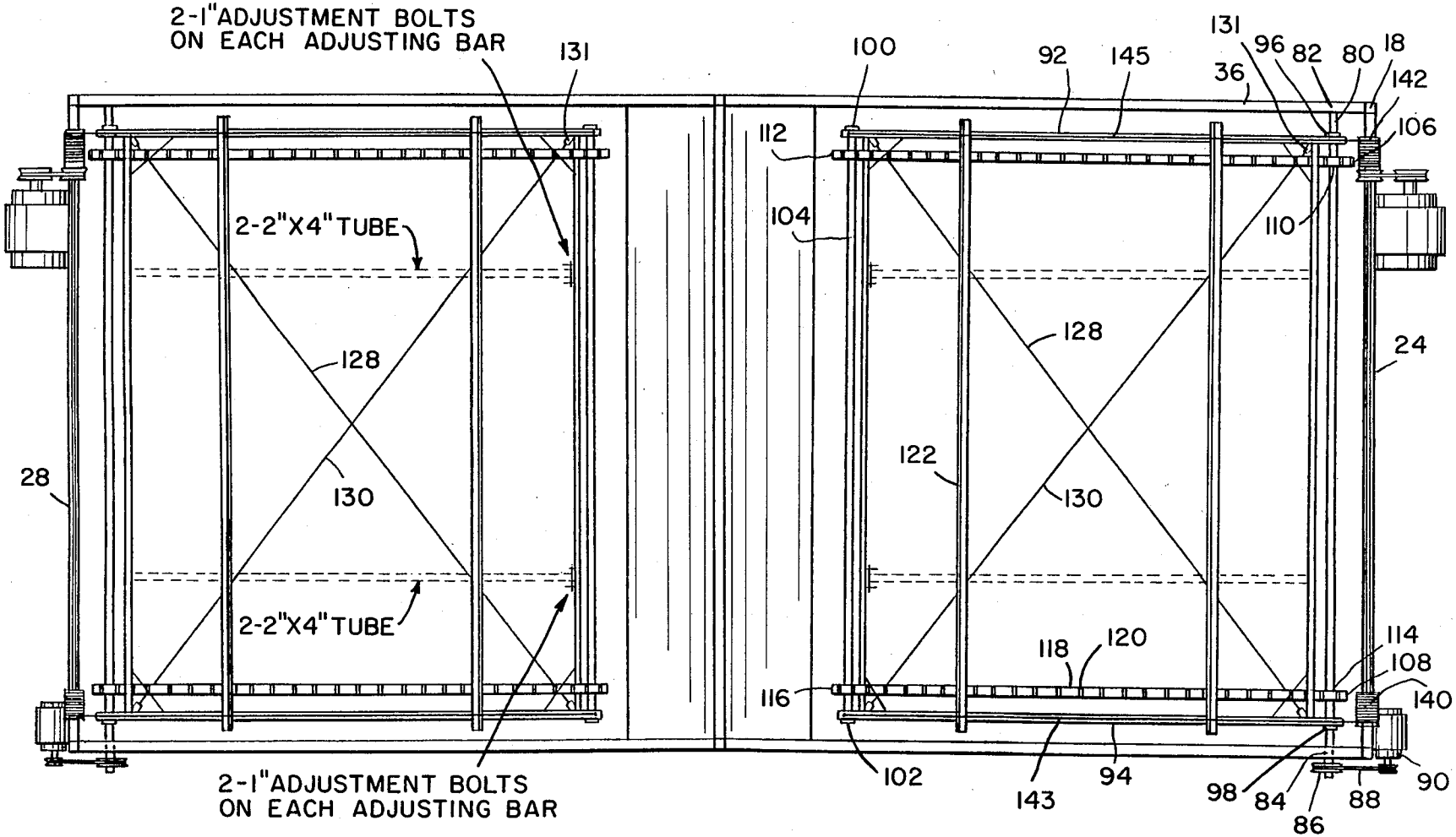
FIG. 3 is a schematic plan view of the embodiment of FIG. 2.

Considering now the ice rake assemblies used with the present invention, each of the ice rake assemblies 6 and 8 is similarly formed so only ice rake assembly 8 will be discussed in detail. As illustrated in FIG. 3, ice rake assembly 8 is oriented along an elongated shaft 80 which extends the length of one of the short sides of the bin, parallel to and slightly above the discharge screw conveyor. The end of the shaft 80 which is opposite from the discharge of screw conveyor, is received in a bearing 82 supporting the end and allowing it to freely rotate. One end of the drive shaft 80 passes through a bearing 84 and extends a short distance outside of the bin enclosure 4. Gear drive wheel 86 is mounted on the extended portion of drive shaft 80. The drive wheel 86 is attached by chain 88 to drive motor 90 which serves to drive the ice rake assembly. An example of a suitable motor would be a 2 h.p., 1140 rpm, Winsmith 20 to 1 (20:1) reducer.

Within the ice bin and located near the edges of the bin are the ice rake arms or rake support rails 92 and 94. Each of these rails comprises a lightweight beam, for example of metal, which extends from the drive shaft 80 at one end of the ice bin, to approximately the middle of the ice bin. In the preferred embodiment, ice rake rails 92 and 94 have a rectangular cross-section and measure approximately 6 inches vertically and 2 inches horizontally. Each of the ice rake rails 92 and 94 has a proximal or attached end rotatively attached to the drive shaft 80 by means of bearings 96 and 98, respectively. These bearings allow the ice rake rails to pivot around the drive shaft 80 but do not impart any rotary motion to the rails. The drive shaft 80 provides support means for the ice rake assembly 6.

At the free or distal ends of ice rake rails 92 and 94 furthest from the drive shaft 80, second bearings 100 and 102, respectively, are provided to receive elongated idler shaft 104. Idler shaft 104 extends the width of the bin between the two ice rake rails 92 and 94, and freely rotates within the bearings 100 and 102.

Drive chains 106 and 108 extend between the drive shaft 80 and idler shaft 104 and provide means for driving the rakes 122 with respect to the arms 92 and 94. Drive sprocket 110 is mounted on drive shaft 80 in a position slightly to the interior of the bin from bearing 96. Idler sprocket 112 is mounted on idler shaft 104 in position so that when drive chain 106 is placed around drive sprocket 110 and idler sprocket 112 the chain is substantially parallel to the bin wall formed by supports 36, 18, 20, and 26. Drive chain 108 is similarly mounted upon drive sprocket 114 and idler sprocket 116 near the other wall of the ice bin.

Figures 4, 4A:
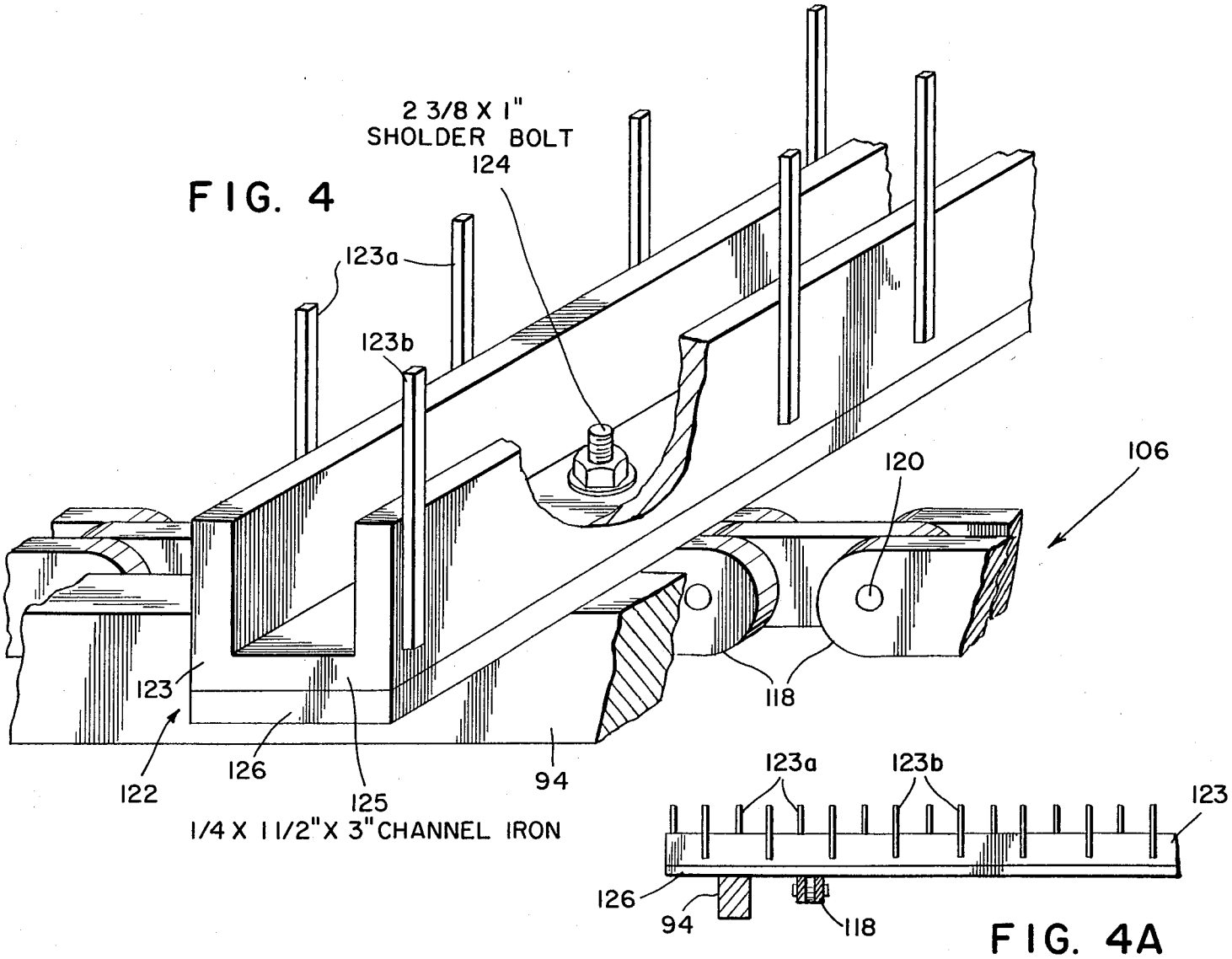
FIG. 4 is an enlarged perspective of a modified embodiment of a rake usable with the embodiments of FIGS. 1 and 2.
FIG. 4A is an end view of the rake of FIG. 4.

Drive chains 106 and 108 are made of a plurality of chain link elements. In the preferred embodiment, the chain links 118 are approximately 6 inches in length and are joined together by pins 120 to form an endless chain, as illustrated in FIG. 4. A model number of a suitable chain is C208-H C.P. plated.

Rakes such as that shown at 122 are attached to the chains 106, 108 at spaced intervals. Each rake is formed either as an L-shaped member, as illustrated in FIGS. 2 and 3, or, preferably, as illustrated in FIG. 4, as a U-shaped member with upstanding arms 123 supporting rake elements **123*a* and 123*b* for contacting and moving the ice, and a base 125 for attachment to the drive chain. Preferably, as illustrated in FIG. 4A, the rake elements 123*a* are staggered with respect to the rake elements 123*b*, for instance, the rake elements 123*a* are located on lines bisecting the gaps between adjacent rake elements 123*b*. The rakes 122 are oriented so that they are perpendicular to the drive chain and extend substantially the entire width of the ice storage bin. The rakes 122 are attached to the drive chain 108 and 106 in a conventional manner such as by bolts, as shown at 124**. An approximate dimension of each rake would be 14' wide, with length and height to order, with changes in width possible. Spacing to be provided between rakes will be up to 16' maximum.

Antifriction plastic strips 126 (FIG. 4), made from material such as that sold under the trademark "Hi-D", are bolted to the outer ends of rakes 122 and ride on the channel arms 94 and 92. The plastic strips are bolted in such a manner that at least $\frac{5}{8}$ inch of the surface can be worn away without exposing the bolt heads to wear. Preferably, antifriction plastic strips (not shown) also are provided on the arms 92 and 94 so that antifriction material slides on antifriction material. Use of an impregnated material provides self-lubrication.

In order to provide stability to the rake arm structure diagonal wire braces 128, 130 can be attached to run diagonally between one end of rake rail 92 and the opposite end of rake rail 94. The support braces are provided with turnbuckles 131 to allow adjustment of the tension on the braces.

Each of the rake arms is mounted so that it may be rotated around its associated drive shaft. The mechanism for accomplishing this rotation is the same for each of the rake arms so only the mechanism for rake arm 8 will be described. As discussed above, drive shaft 80 is mounted in bearings 82 and 84 at each end of the shaft so that it may be rotated within these bearings. Drive shaft 80 serves the dual purpose of transmitting power from the drive motor 90 and providing a pivot point for the rake arm 8. Rake arm 8 is moved from a lowered or horizontal position shown in the drawings, to a raised or vertical position by means of rake hoist assembly 134, as illustrated in FIG. 2. Mounted on the side of the storage bin 4 is rake hoist motor 136 which is connected to rake hoist drive shaft 138 by hoist drive chain 137. Drive shaft 138 drives cable reels 140 and 142 located at each end of the cable reel drive shaft 138. The hoist cables 143 and and 145 are connected from the cable reels to ends of the rake rails 94 and 92, respectively.

In operation, the rake hoist assembly 134 causes the cables to wind around rake hoist drums 140 and 142 which, in turn, cause rake arm 8 to pivot around drive shaft 80 towards a vertical position, with idler sprocket 116 moving along the path indicated by a dotted line in FIG. 2.

In an alternative, less preferred embodiment shown in FIG. 1, a manual crank 144 with recoil springs 146 and 148 is used in place of hoist drive motor 135. Manual crank 144 is used to manually raise rake arm 8 from the horizontal to vertical position, and the recoil springs 146 and 148 serve to reduce the manual effort required to raise rake arm 8.

One embodiment of the rake arm drive uses a $\frac{1}{2}$ h.p. D.C. motor with 750-1 Winsmith gear reducer. Use of a D.C. motor with variable speed control allows the rake arms to be lowered or raised at different speeds by changing voltage. Preferably, a jog control allows the rake arms to break ice loose when the arms are in a storage fill position without lowering arms for maximum ice flow control.

Figure 6:
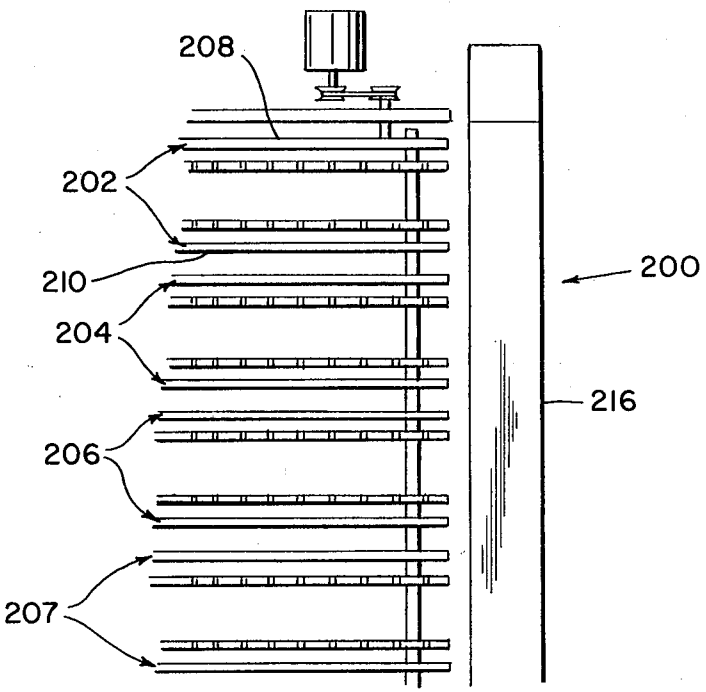
FIG. 6 is a partial plan view of the embodiment of FIG. 5.

Referring now to FIGS. 5 to 7, still another embodiment of the present invention is illustrated. In this embodiment, an ice storage bin, generally designated 200, has a plurality of ice rake assemblies 202, 204, 206, and 207 placed in a side-by-side relationship. Each assembly has a pair of parallel ice rake arms or rake support rails 208 and 210. A shaft 212, which is similar to the shaft 80, forms support means for proximal or attached ends of the rails. Free or distal ends of the rails are closely spaced from a divider (not shown) similar to the divider 46, or are closely spaced from a sloping bottom portion (not shown) similar to the portion 48 illustrated in FIG. 1.

Drive chains, similar to the chains 106 and 108, and rakes, similar to the rakes 122, are associated with each pair of support rails 208 and 210. Also, a suitable mechanism (not illustrated) is provided for rotating the supporting rails about the shaft 212.

This embodiment of the invention differs from the preceding embodiments in that it utilizes a screw conveyor 214 positioned in a housing 216. Preferably, the housing 216 has an open bottom or a base placed directly on the floor of the insulated structure receiving the storage bin 200. There is no need to form a trough in the floor of the structure to receive the screw 214 or to raise the floor of the bin 200 above the floor of the insulated structure. An end 218 of the screw projects from the housing and is operatively associated with a drive motor 220. The end of the housing 216 spaced from the drive motor 220 has an opening 222 formed therein that communicates with a discharge housing 224. The opening 222 is sized in such a manner that provision is made for a limited amount of storage of fragmentary ice within the housing 216 so as to prevent surges of fragmentaty ice during a discharge or feeding operation. Also, a level sensor 225 is positioned in the vicinity of the opening 222 to deenergize the drive or drives associated with the ice rake assemblies when a sufficient amount of ice has been accumulated within the housing 216.

The sidewall of the housing 216 facing the ice rake assemblies is open along substantially its entire length. A vertically movable door assembly 226 controls the size of the passageway between the housing 216 and the ice rake assemblies 202, 204, and 206. The door assembly 226 includes a door 228 and means for controlling vertical movement of the door. The means, which has been designated 230, can take any form well known to those skilled in the art, such as the mechanisms previously described that control raising and lowering of the support rails 92 and 94.

When the door is in its lowermost position, there is substantially no flow of fragmentary ice into the housing 216. When the door 228 is in an uppermost position, flow of fragmentary ice into the housing 216 is substantially unimpeded. Positioning of the door 228 in a position intermediate the extreme positions provides a means for controlling the amount of fragmentary ice delivered into the housing 216. Thus, the door 228 provides means for controlling the rate of discharge of fragmentary ice, and there is no need to provide a variable speed motor for driving the shaft 212.

In operation of the bin, rake arms or support rails 92 and 94 of the assemblies 6 and 8 are first placed in their raised or vertical positions and the conveyor doors are closed to prevent ice from entering, and possibly jamming, screw conveyors 50, 64, or 214. The ice bin is then filled with fragmentary ice by means of a screw conveyor (not shown) feeding into the center of the bin. As the bin fills, the ice, by gravity, will peak in the center and be distributed towards the side and end walls.

When the room has become sufficiently filled, rake arms 6 and 8 are lowered from their raised positions until they rest against the pile of ice; and the conveyor doors are opened. Tension on rake hoist cables 143 and 145 is totally released so that the rake arms, by gravity, dig into the pile of ice in the room. At this point the motor 90 is started causing the chain drive and, hence, the rakes to rotate in the direction of arrow "y" in FIG. 2. This action of the rakes causes the ice to be scraped towards the screw conveyor 50 which is also rotating to move and discharge the ice from the bin. The divider 46, in the dual rake configuation, causes any ice which remains in a nearly empty bin to slide by action of gravity to a position where it will be scraped away by one of the rake arms.

In a preferred embodiment, the motor controlling raising of the rake arms is energizable to control downward movement of the arms 6 and 8 so as to control the pressure exerted on the ice by the rake arms. Also, the rake arms can be raised and dropped to facilitate breaking of any ice masses formed within the bin.

In an alternative embodiment, where the sloping ramp 48 is used with a single rake arm, gravity causes the last remaining pieces of ice to slide down to a point where they can be seized by the rake arm and delivered to the screw conveyor.

If additional ice is to be introduced into the bin while the rake arms are in operating positions, the rake arms can be raised slightly from the top of the ice pile through the use of the mechanized or manual cable hoist, and an increased volume of ice accomodated.

A bin according to the preferred embodiment of this invention will hold a considerable amount of ice in rooms with varying dimensions. This can be accomplished in three ways.

First, an ice storage bin can be built using dual rake arms placed in opposite ends of the bin. Each of the two rake arms is only one half the length of the bin which allows the individual arms to be raised to vertical positions in spaces equal to half the length of the bin. If only one arm were used for the entire length, the height of the bin would have to be equal to its length. Since there are few overhead pulleys required, this embodiment allows a long room with a low ceiling to be used to store the maximum amount of ice.

Second, by adding a sloping bottom 48 to one side of the bin, a large amount of ice can be stored in a bin where only one rake arm, extending less than the full length of the bin, is used.

Third, in the case of a room having a considerable width, two or more rake assemblies constructed according to the present invention can be placed side-by-side to feed a single discharge auger. Preferably, the plurality of rake assemblies are supported by and rotatably driven by a common shaft.

A further advantage of the present invention is that the motors and chain drives for all of the equipment lie outside of the ice storage bin, allowing maintenance work to be readily performed upon the equipment without a danger of contaminating the ice within the bin. Further, broken or leaking equipment will not contaminate the ice in the storage bin.

Although, the present invention has been shown and described in terms of specific preferred embodiments, it will be appreciated by those skilled in the art that changes or modifications are possible which do not depart from the inventive concepts described and taught herein. Such changes and modifications are deemed to fall within the purview of these inventive concepts.

What is claimed is:

1. A self-evacuating ice storage bin for the storage and delivery of fragmentary ice from an enclosure having a floor and side walls, said bin comprising:

supporting means adjacent the floor of said enclosure for supporting at least one ice rake assembly for pivoting movement about a pivot axis within said enclosure;

at least one ice rake assembly having a plurality of movable rake elements for contacting said ice, said at least one ice rake assembly having at least one rake arm for carrying said rake elements, said rake arm including a free end and an attached end, said attached end being pivotably connected to said support means near the junction of said floor and one of said side walls, said at least one ice rake assembly having at least four rakes, and further including at least two rake arms for supporting said rakes, and friction reducing means for reducing friction between the rakes and rake arms, said friction reducing means being attached to each rake at the point of contact with said rake arm;

drive means for driving said plurality of rake elements so that they move along said rake arm in a direction which causes said fragmentary ice to be moved towards said attached end of said arm; and discharge means adjacent said support means for receiving and for discharging from said bin the ice moved towards said attached end of said at least one rake arm by said rake elements, and covering means for covering said discharge means in order to prevent damage to said discharge means during the filling of said ice bin.

2. A bin as recited in claim 1, wherein said drive means is mounted outside of said support means.

3. A bin as recited in claim 1, further comprising hoisting means for pivoting said at least one rake arm about said attached end from a first position in contact with said ice to a second position spaced from said ice.

4. A bin as recited in claim 1, wherein said drive means includes a drive shaft, and wherein said pivot axis of said support means is coincident with the axis of said drive shaft.

5. A bin as recited in claim 1, further comprising a second rake arm disposed so that said attached end of said second rake arm is located parallel to and on the opposite side of the bin from said first rake arm attached end.

6. A bin as recited in claim 1, wherein said discharge means comprises a screw conveyor positioned so as to move ice along the floor of the enclosure.

7. A bin as recited in claim 1, further comprising distributing means for causing said ice to be distributed within said ice storage bin so that said rake elements can contact and move said ice.

* * * * *